United States Patent [19]

Brown

[11] 4,055,874

[45] Nov. 1, 1977

[54] COMBINATION PLASTIC AND METAL PAPER CLIP

[76] Inventor: Dwight C. Brown, 1516 N. Nicholas St., Arlington, Va. 22205

[21] Appl. No.: 670,065

[22] Filed: Mar. 24, 1976

[51] Int. Cl.[2] ..... B42F 1/00; A44B 21/00

[52] U.S. Cl. ..... 24/67.3; 24/67.9; 24/255 R

[58] Field of Search ..... 24/67.9, 67.3, 255 D, 24/255 G, 255 H, 255 R, 255 GP, 262 R, 262 GC; 40/23 A

[56] References Cited

U.S. PATENT DOCUMENTS

| | | | |
|---|---|---|---|
| 1,713,994 | 5/1929 | Carter | 24/67.9 |
| 1,916,856 | 7/1933 | Copeman | 24/138 R |
| 2,113,953 | 4/1938 | Steinberger | 24/262 GC |
| 2,146,190 | 2/1939 | Luke | 24/262 R |
| 2,378,747 | 6/1945 | Berman | 24/255 H |
| 2,478,376 | 8/1949 | De Swart | 24/255 P |
| 2,938,252 | 5/1960 | Scheemaeker | 24/67.9 |

FOREIGN PATENT DOCUMENTS

| | | | |
|---|---|---|---|
| 1,448,384 | 6/1966 | France | 24/255 P |
| 1,183,595 | 7/1959 | France | 24/67.9 |

*Primary Examiner*—Bernard A. Gelak

*Attorney, Agent, or Firm*—Stevens, Davis, Miller & Mosher

[57] ABSTRACT

A paper clip is disclosed for clampingly engaging at least two sheets of paper. The paper clip includes a semi-rigid plastic body member, substantially U-shaped in longitudinal cross-section, having a pair of legs presenting two substantially planar interior surfaces between which paper sheets may be clamped and a longitudinally extending substantially rigid, but slightly flexible metal member fixedly secured to the body away from the interior surfaces thereof so as to present only those planar surfaces to paper sheets clamped therebetween. The metal member may be a rod or strip and may be embedded in the body member or secured to the exterior surfaces of the body member. Also, the interior surfaces of the body member may be coated with an abrasive material or roughened to increase the effective clamping hold of the clip.

12 Claims, 10 Drawing Figures

COMBINATION PLASTIC AND METAL PAPER CLIP

BACKGROUND OF THE INVENTION

1. Field of the Invention

This invention relates to fasteners generally referred to in the trade as paper clips, and more particularly to a clip having a formed hinged plastic body which incorporates one or more longitudinal members of wire or other relatively flat shaped metal, for the purpose of providing additional friction holding power.

In my prior U.S. Pat. No. 3,604,067 entitled "Clip Structure" and granted Sept. 14, 1971, I disclose various modifications of a combination flat metal and plastic foam fastener. This clip structure has an exposed surface of metal and the inner side is lined with spongy plastic foam material for providing additional frictional holding power and additional protection to the papers fastened.

Such clips perform very satisfactory for fastening a relatively small number of thin paper sheets, but lack sufficient friction holding power for securely fastening a large number of sheets. In addition, such clips require painting or other protective coating of the exposed metal surface to prevent rusting. To increase friction holding power and provide full protection of the metal from rusting, I have found that the use of a flat type clip comprising a wire, strip or other longitudinal shaped metal member on or otherwise embedded in a flexible plastic body member, or positioned between two sheets or strips of such plastic, has distinct advantages and it is to that end that the present invention is directed.

2. Description of the Prior Art

Paper clips now in use are generally those of metal or plastic construction. Although most clips made of plastic provide an ample amount of flat surface for contact with the papers fastened, their friction holding power is limited and is usually less than that provided by a metal type clip.

At present, the most common type of paper clip is in the form of a wire shaped unit providing spring gripping action for holding sheets of paper together. These clips have the disadvantage that they mark, mar, indent, or distort fastened paper material. If the paper has to be duplicated, the duplicated sheet will frequently bear a mark where the clip indented the master. Moreover, this problem can be serious in computer cards, wherein an indentation on the card could result in improper processing of the card and costly machine down time. To eliminate this indentation both on paper and cards, it is a general practice to use small pieces of folded paper or card stock, placed between the wire gripper surfaces, to serve as protection pads. This is costly in terms of both material and time.

Other disadvantages of the wire clip include frequent discoloration of the paper caused by rust formed on the clip, and undesired easy detachment of the clip during stacking and filing of the fastened groups of papers. Although there have been several attempts to provide a low cost flat type clip to eliminate the deficiencies of the wire clip, the metal or plastic construction used does not provide sufficient friction holding power for good paper fastening.

Accordingly, it is an object of this invention to provide a paper clip having substantial relatively flat or planar interior surfaces which will not mar, mark, indent, or distort the paper and which will provide sufficient friction holding power to fasten separate sheets of paper, cards, or other flat material securely together.

A further object of this invention is to provide a flat type paper clip having a plastic formed hinge, such clip incorporating embedded or enclosed metal wire, strip or other relatively flat metal members, and providing the required friction holding power and which members, because of their enclosure in the plastic material, will not rust.

An additional object of this invention is to provide a paper clip of the character described, with the wire, strip, or other flat metal member removed or not present in the free end portion of one of the gripping legs, thus facilitating spreading of the gripping legs for easy threading and attachment to the papers to be fastened.

Another object of this invention is to provide a low cost machine formed flat type hinged paper clip of the character described which can be used for a variety of paper and other material fastening applications, and which can be readily fabricated in various sizes and modifications to meet needed fastening requirements.

Still another object of this invention is to provide a large type paper clip with a thumb access hole in one of the gripping legs of the clip to facilitate insertion and attachment of the papers to be fastened.

These objects are accomplished by combining the use of semi-rigid plastic and the superior friction holding power and springiness of metal in a construction that can provide weather protection for the metal and at the same time provide relatively flat or planar interior surfaces, thus eliminating the forementioned deficiencies and disadvantages of conventional paper clips such as the commonly used wire type clip.

Preferred methods of fabrication involve the use of metal wire or rod, metal strip, or other longitudinally extending relatively flat or planar metal member, laminated, embedded or otherwise enclosed in or attached or fixedly secured to plastic in sheet or roll strip form, or laminating or embedding such metal between two such forms of such flexible plastic to form a continuous strip which is then run through a machine for cutting and shaping the individual clips in accordance with the construction and modifications shown in the drawings. Other alternate methods of construction can be used such as molding, thermoforming, or spraying the plastic compound over the wire, rod, strip or other longitudinal flat metal member, in such a way as to provide a relatively flat surface on at least one side which becomes the interior sides of the legs of the finished fastener which contacts the papers to be fastened.

Other objects and advantages of this invention will become apparent from the following specification, claims and accompanying drawings.

DESCRIPTION OF THE PREFERRED EMBODIMENTS

Figure 1:
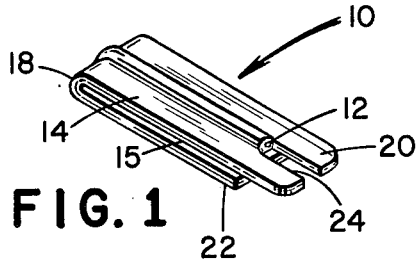
FIG. 1 is a perspective view of one form of paper clip forming the subject of the present invention.
Figure 2:
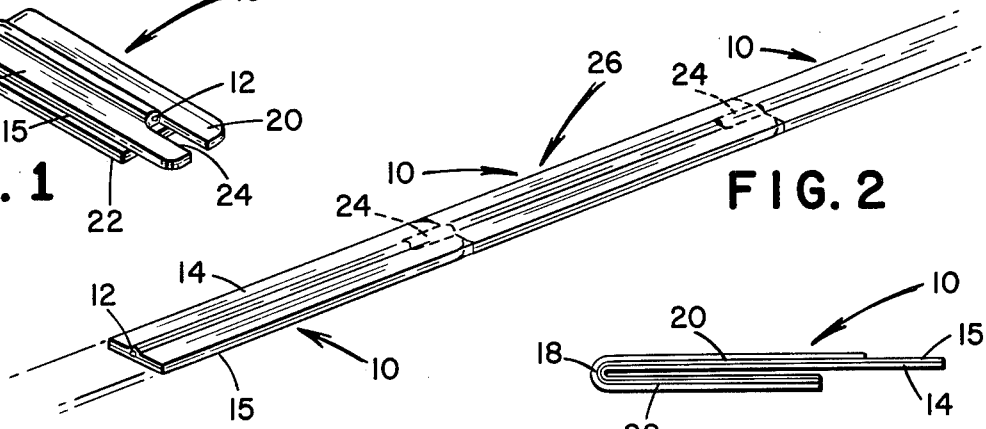
FIG. 2 is a perspective view of a continuous strip of wire between two layers of plastic prior to cutting and shaping of the clip.
Figure 3:
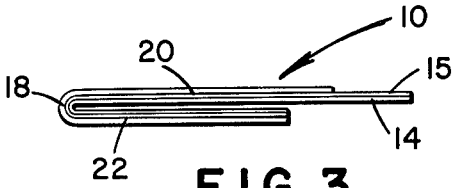
FIG. 3 is a side view of the clip shown in FIG. 1.

In FIG. 1 is shown a paper clip 10 hinged at one end 18. The clip 10 is cut and formed from a continuous strip 26 consisting of a wire 12 laminated between a body member comprising two flat strips of plastic 14 and 15. The bottom layer of plastic 15 is relatively flat and the top layer of plastic 14 is formed over the wire 12. The flat bottom layer 15 of the laminated continuous strip 26 after clip production becomes the planar interior sides of the legs of the finished clip 10. The clip 10 is substantially U-shaped in longitudinal crosssection and comprises a hinge 18 (the bight of the U) and a pair of gripping legs 20 and 22. The leg 20 is longer than the leg 22. The broken lines in FIG. 2 indicate that portion of the wire and plastic which is cut out and removed to form a slot 24 in the longer gripping leg 20 after the cutting and forming operation. Removal of the wire as indicated by the broken lines, increases the flexibility of the end portion of the longer gripping leg 20 thus making it easier to bend and feed on the papers to be fastened. After cutting of the longitudinal laminated wire-plastic strip 26, the individual cut piece is shaped to form the clip 10 by bisecting the individual cut piece to form the hinge 18 and the two unequal length spacedapart gripping legs 22 and 24.

Separate paper sheets or other material to be fastened together are inserted between the facing resilient and compressible gripping legs in contact with the interior surface of clip 10 by bending the lower end of the longer gripping leg 20 and sliding the two gripping legs 20 and 22 over the papers until the top part of the papers come in contact with the underside of the hinge 18.

After removal of the clip 10 from the fastened papers, the resilient clip will return to its original FIG. 1 shape ready for re-use. The resilient layers 14 and 15 together with the spring quality of the metal wire 12 will generate sufficient friction holding power to prevent the secured papers from slipping from the interior of the clip.

The selection of both the semi-rigid plastic material of the layers 14 and 15 of the body member and the substantially rigid, but slightly resilient metal wire 12 material is important. The plastic and metal must have the proper thickness and temper to enable repeated use and bending at the hinged section 18 without breaking or deforming. In addition, the spring qualities of the metal wire 12 must provide sufficient compression and the necessary friction holding power in the gripping legs 20 and 22 for the intended fastening application.

It will be noted that the lower edge of the longer gripping leg is substantially arcuate to facilitate attachment of clip 10 over the edges of the papers to be fastened.

Figure 4:
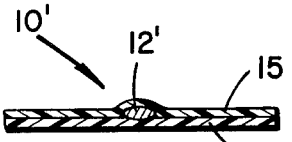
FIG. 4 is a transverse cross-sectional view of an alternative embodiment of the invention.

FIG. 4 shows an alternative embodiment of the invention in which a clip 10' comprises a plastic body member formed in two layers 14, 15 between which a metal member 12', oval in cross-section, is positioned. Other than the shape of the metal member, the clip 10'' is substantially identical to the clip 10 shown in FIG. 1.

Figure 5:
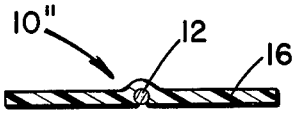
FIG. 5 is a cross-sectional view of another alternative embodiment of the invention having one layer of plastic material, into which is pressed a continuous wire using heat or other means.

FIG. 5 illustrates an alternative embodiment of the invention in which a clip 10'', substantially U-shaped in longitudinal cross-section, is formed by pressing and embedding a continuous wire 12 into a body member comprising a single layer of plastic material 16 by use of heat or other means. The wire or other metal strip may or may not be fully embedded in the plastic but should be sufficiently embedded to prevent detachment and provide a relatively flat surface for at least one side, which becomes the interior side of the clip after cutting and forming. The plastic used may be in flat strip or sheet form or may be extruded or otherwise formed, shaped or molded fully or partly around the metal wire or other metal strip 12 to form an integrated plastic-metal construction which if desired can be assembled in roll form for later processing through a machine which cuts and shapes the finished clip.

Figure 6:
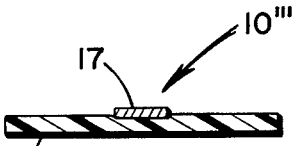
FIG. 6 is a cross-sectional view of another alternative embodiment of the invention having one layer of plastic material adhesively or otherwise attached to a longitudinal strip of relatively narrow flat metal in strip form treated or sprayed for weather protection.

FIG. 6 illustrates an alternative embodiment of the invention in which a clip 10''', substantially U-shaped in longitudinal cross-section, consists of a longitudinal relatively flat and narrow strip of metal 17 adhesively or otherwise attached to one layer 16 of plastic material. In the machine cutting and forming of the FIG. 6 embodiment, the side to which the metal is attached becomes the exterior side of the clip and the flat plastic side 16 becomes the interior surfaces of the clip which contact the papers to be fastened.

Figure 7:
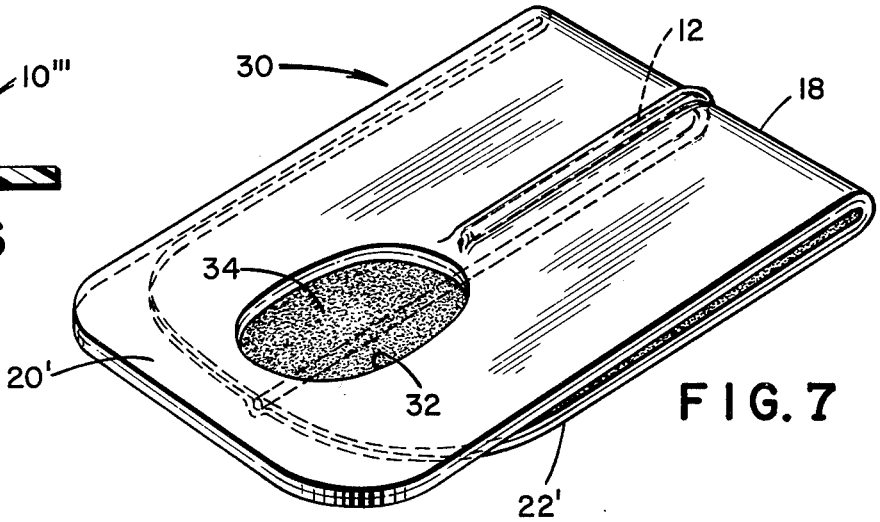
FIG. 7 is a perspective view of another alternative embodiment of the invention having a single strip of wire between two layers of plastic material and having a hole in the longer gripping leg for insertion of the thumb or finger therethrough.

The FIG. 7 clip designated by the numeral 30 is another embodiment of the invention. The clip 30 is substantially U-shaped in longitudinal cross-section and may be longer and wider than the previously described embodiments to form a large clip having two unequal length gripping legs 20' and 22' both closed at their free ends. The longer gripping leg 20' has a hole 32 defined therein near the free end thereof for insertion of the end of a thumb or finger therethrough to facilitate spreading the two gripping legs 20', 22' for easy threading and attachment of the clip 30 to the papers to be fastened. In this embodiment, the relatively flat interior surfaces of the legs of the clip 30 are coated or lined with an abrasive material 34 or other material having qualities which will provide additional holding power for securing the papers fastened. Alternatively, the plastic material layer on the inside of the clip may be roughened and such roughened surface will form the inside of the cut and formed clip 30, giving the clip additional frictional holding power. The wire 12 on the longer gripping leg 20' extends to the edge of the hole 32 whereas on the shorter gripping leg 22' the wire 12 extends to its free edge. The leg 22' is the back side of the clip 30 when in use. The absence of the wire 12 in the end portion of the longer gripping leg 20', from the bottom edge of the hole to the free or bottom edge of said gripping leg 20', provides easy bending of the flexible semi-rigid plastic material and facilitates threading and attaching the clip to the papers to be fastened.

Figure 8:
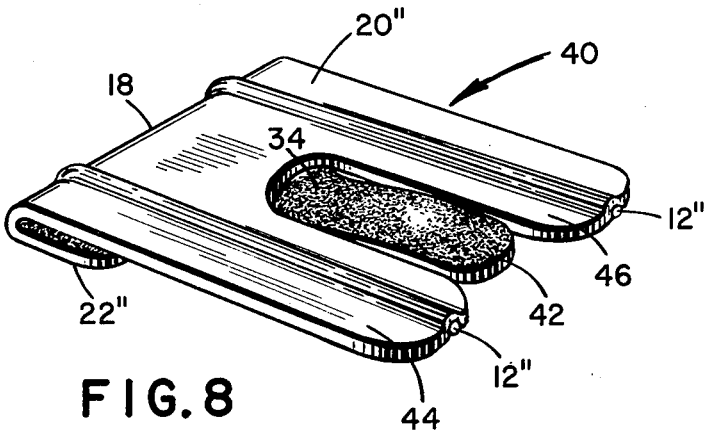
FIG. 8 is a perspective view of another alternative embodiment of the invention having two strips of wire between two layers of plastic material.
Figure 9:
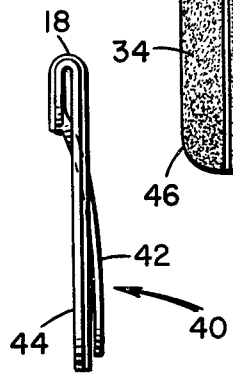
FIG. 9 is a side view of the clip shown in FIG. 8.

In FIG. 8 is shown another embodiment of the invention in the form of a clip 40 which is also particularly applicable for large clip construction. Clip 40 is substantially U-shaped in longitudinal cross-section and is made of two or more wires 12 or flat metal strips laminated between two layers of plastic material 20" and 22" and has two unequal length gripping fingers or legs. One of the legs comprises a pair of leg members 44 and 46 on the top side when in use and the other leg comprises one gripping leg member 42 on the opposite or bottom side of the clip 40 when in use. The gripping leg member 42 extends through the slot defined between the spaced-apart gripping leg members 44 and 46. The upper part of clip 40 is full width on both sides of the upper sections extending from hinge 18. On the gripper leg member 42 side, two wires 12 extend downwardd from hinge 18 to a point approximately one third the length of the longer gripping leg members 44 and 46 to provide maximum friction holding power. Although no wire is incorporated in the shorter gripping leg member 42, that leg member provides supplemental friction holding power since it is off-set from the two other gripping leg members 44 and 46. Alternatively, wire could be incorporated in the leg member 42 to modify it if desired. The gripping leg member 42 may extend to any degree required through the spaced-apart gripping leg members 44 and 46. For attaching clip 40 to papers, the gripping leg member 42 is pressed back through the slot between the leg members 44, 46 to provide the necessary spacing between the leg member 42 and the gripping leg members 44 and 46 for threading the clip on the papers to be fastened. The inside surfaces of clip 40, as with clip 30, may be coated or lined with an abrasive or other friction holding material, or may be roughened to provide additional friction holding power. The off-set of the shorter gripping leg member 42 from the other equal length gripping leg members 44 and 46 on the opposite side of the clip 40 is illustrated in FIG. 9.

Figure 10:
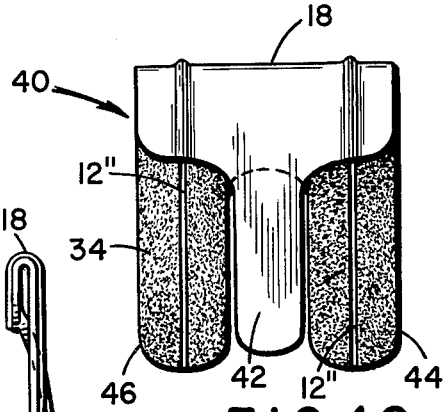
FIG. 10 is a plan view of the back side of the clip shown in FIG. 8.

FIG. 10 illustrates the back side of the large clip 40, the top side of which when in use, is illustrated in FIG. 8. The exposed planar interior sides of the gripping leg members 44 and 46 show the coated abrasive or other friction holding material, or roughened surface which covers all of the interior surfaces of the clip 40 including the hinge section 18. The wires 12 are laminated between two layers of plastic material so as to provide the relatively flat or planar interior surfaces of the legs of the clip 40. The thickness of the plastic material of the two layers may differ or the two layers may be of the same thickness. The hinge section 18, starting at the top edge has two wires 12" which extend downward approximately one-third the length of the two gripping leg members 44 and 46. The configuration of clip 40 provides good utilization of the wire laminated plastic strip material from which the clip is cut and formed. This is due to the fact that the single gripping leg member 42 is formed from the material cut between the two equal length gripping leg members 44 and 46. The dotted line in FIG. 10 illustrates the point where the leg member 42 is bent and shaped to protrude through the slot between the spaced-apart gripping leg members 44 and 46.

In each of the embodiments described above, it is apparent that the transverse cross-sectional area of the metal member is considerably less than that of the body member and yet the metal member sufficiently rigidifies the larger body member. For example, in the FIG. 5 embodiment, the cross-sectional area of the metal wire or rod 15 is less than 1/15th that of the body member 16. In each of the embodiments, the cross-sectional area of the metal member is less than 1/5th that of the plastic body member.

It will be apparent from the foregoing that a new relatively flat type clip, at least on the interior surfaces, incorporating an integral combination plastic and metal constructed clip, has been disclosed, and that such clip lends itself to a variety of applications. The clip is easily attached to paper sheets and does not require extreme care in threading such as is applicable to the wire clip in wide use today. The metal part being rigidly enclosed or attached to the plastic material forms a clip body structure which, unlike conventional wire type clips, cannot get distorted and out of shape after use. The relatively flat surface on the exterior side of the clip is ample and conducive to color coding and marking for identification purposes of the papers attached. This is a distinct advantage over the common wire type clip which has no flat surface for color coding or printing.

What I claim is:

1. A paper clip for clampingly engaging at least two sheets of paper, said paper clip comprising:

a body member, substantially U-shaped in longitudinal cross-section, of semi-rigid, generally flexible plastic sheet material, said body member having a pair of legs presenting two substantially planar interior surfaces between which at least two sheets of paper may be clamped, one of said legs being longer than the other; and a longitudinally extending substantially rigid, but slightly flexible rigidifying metal member, of substantially smaller transverse cross-section than that of the body member, fixedly secured to said legs away from the interior surfaces thereof so as to present only the planar interior surfaces of the body member to paper sheets clamped therebetween, said metal member being not coextensive with the part of the longer leg which extends beyond the other leg whereby that part of the longer leg is more flexible than any part secured to the metal member.

2. A paper clip as claimed in claim 1, wherein:

the body member comprises two coextensive sheets of semi-rigid plastic and the metal member is positioned between the sheets of semi-rigid plastic.

3. A paper clip as claimed in claim 1, wherein:

the metal member is embedded in the body member.

4. A paper clip as claimed in claim 3, wherein:

said metal member is a rod.

5. A paper clip as claimed in claim 1, wherein:

said metal member is secured to the exterior of the body member.

6. A paper clip as claimed in claim 5, wherein:

said metal member is a strip.

7. A paper clip as claimed in claim 1, wherein:

the interior surfaces of the legs are coated with an abrasive material.

8. A paper clip as claimed in claim 1, wherein:

the interior surfaces of the legs are roughened so as to be non-slipping.

9. A paper clip for clampingly engaging at least two sheets of paper, said paper clip comprising:

a body member, substantially U-shaped in longitudinal cross-section, of semi-rigid, generally flexible plastic sheet material, said body member having a pair of legs presenting two substantially planar interior surfaces between which at least two sheets of paper may be clamped, one of said legs being longer than the other and terminating in a free edge having a central longitudinal notch defined therein which extends inwardly from the free edge; and a longitudinally extending substantially rigid, but slightly flexible rigidifying metal member, of substantially smaller transverse cross-section than that of the body member, fixedly secured to said legs away from the interior surfaces thereof so as to present only the planar interior surfaces of the body member to paper sheets clamped therebetween, said metal member is not coextensive with the notch whereby the portion of the longer leg coextensive with the notch is more flexible than any portion secured to the metal member.

10. A pater clip as claimed in claim 9 wherein: said free edge is substantially arcuate.

11. A paper clip for clampingly engaging at least two sheets of paper, said paper clip comprising:

a body member, substantially U-shaped in longitudinal cross-section, of semi-rigid, generally flexible plastic sheet material, said body member having a pair of legs presenting two substantially planar interior surfaces between which at least two sheets of paper may be clamped, one of said legs being longer than the other and having a hole defined therethrough, adjacent the end thereof most remote from the bight of the U, through which a finger can be inserted to move the legs away from each other for insertion of sheets of paper therebetween; and a longitudinally extending substantially rigid, but slightly flexible rigidifying metal member, of substantially smaller transverse cross-section than that of the body member, fixedly secured to said legs away from the interior surfaces thereof so as to present only the planar interior surfaces of the body member to paper sheets clamped therebetween, said metal member secured to said longer leg being not coextensive with said hole whereby the portion of said longer leg coextensive with said hole is more flexible than any portion secured to the metal member.

12. A paper clip for clampingly engaging at least two sheets of paper, said clip comprising:

a body member, substantially U-shaped in longitudinal cross-section, of semi-rigid, generally flexible plastic sheet material, said body member having a pair of legs presenting two substantially planar interior surfaces between which at least two sheets of paper may be clamped;

one of said legs comprises a pair of first longitudinally extending leg members transversely spaced from each other to define a longitudinally extending slot therebetween which extends inwardly from the free edge of said one leg;

the other of said legs comprises a second leg member, substantially coextensive with said slot but of a width slightly less than that of the slot, which may extend through the slot when paper sheets are not clampingly engaged between said first and second legs;

a pair of substantially longitudinally extending substantially rigid; but slightly flexible rigidifying metal members, of substantially smaller transverse cross-section than that of said body member, fixedly secured to said body member away from the interior surfaces thereof so as to present only the planar interior surfaces of the body member to paper sheets clamped therebetween;

one of said pair of metal members being substantially centrally disposed relative to and fixedly secured to one of said pair of first leg members, said one metal member also being fixedly secured to a portion of the other of said legs other than said second leg member; and the other of said pair of metal members being substantially centrally disposed relative to and fixedly secured to the other of said pair of first leg members, said other metal member also being fixedly secured to portion of the other of said legs other than said second leg member whereby said second leg member is more flexible than any part of the body member secured to said metal members.

* * * * *